US010738634B2

(12) United States Patent
Lamson

(10) Patent No.: US 10,738,634 B2
(45) Date of Patent: Aug. 11, 2020

(54) CONTACT COUPLED SINGLETS

(71) Applicant: UNITED TECHNOLOGIES CORPORATION, Farmington, CT (US)

(72) Inventor: Scott H. Lamson, Menands, NY (US)

(73) Assignee: Raytheon Technologies Corporation, Farmington, CT (US)

( * ) Notice: Subject to any disclaimer, the term of this patent is extended or adjusted under 35 U.S.C. 154(b) by 148 days.

(21) Appl. No.: 16/039,726

(22) Filed: Jul. 19, 2018

(65) Prior Publication Data

US 2020/0024989 A1 Jan. 23, 2020

(51) Int. Cl.
*F01D 9/04* (2006.01)
*F01D 5/22* (2006.01)

(52) U.S. Cl.
CPC ..... *F01D 9/041* (2013.01); *F01D 5/225* (2013.01); *F05D 2220/32* (2013.01); *F05D 2230/21* (2013.01); *F05D 2230/60* (2013.01); *F05D 2240/12* (2013.01)

(58) Field of Classification Search
CPC ..... F01D 5/225; F01D 9/041; F16B 5/0004–0012; F16B 5/002; F16B 5/0032; F16B 5/0044; F16B 5/0052; F05D 2260/36
See application file for complete search history.

(56) References Cited

U.S. PATENT DOCUMENTS 2,220,918 A * 11/1940 Smith ..... F01D 5/225 416/191
3,545,882 A * 12/1970 Williamson ..... F01D 5/225 416/190
6,196,794 B1 * 3/2001 Matsumoto ..... F01D 5/34 415/191
6,217,282 B1 * 4/2001 Stanka ..... F01D 9/042 415/209.2
6,425,738 B1 * 7/2002 Shaw ..... F01D 9/041 415/208.1
6,821,087 B2 * 11/2004 Matsumoto ..... F01D 5/282 415/191

(Continued)

FOREIGN PATENT DOCUMENTS

DE 102010041808 4/2012
DE 102010041808 A1 * 4/2012 ..... F01D 9/042

(Continued)

OTHER PUBLICATIONS

European Patent Office, European Search Report dated Oct. 18, 2019 in Application No. 19186492.5.

*Primary Examiner* — Michael Lebentritt
*Assistant Examiner* — Topaz L. Elliott
(74) *Attorney, Agent, or Firm* — Snell & Wilmer L.L.P.

(57) ABSTRACT

The present disclosure provides an airfoil assembly comprising a first segment comprising a first shroud and a second shroud radially outward of the first shroud, a second segment comprising a first shroud and a second shroud radially outward of the first shroud, and a first coupling coupled to at least one of the first shroud or the second shroud of the first segment and a second coupling coupled to at least one of the first shroud or the second shroud of the second segment, wherein the first segment and the second segment are coupled together by a first land of the first coupling and a second land of the second coupling.

17 Claims, 7 Drawing Sheets

(56) References Cited

U.S. PATENT DOCUMENTS

| | | | | |
|---|---|---|---|---|
| 6,910,854 | B2 | 6/2005 | Joslin | |
| 7,722,320 | B2 * | 5/2010 | Matsumoto | F01D 9/041 415/115 |
| 8,092,165 | B2 * | 1/2012 | Bouchard | F01D 9/02 29/889.22 |
| 9,127,562 | B2 * | 9/2015 | Raible | F01D 5/143 |
| 10,273,972 | B2 * | 4/2019 | Maalouf | F02C 3/04 |
| 2004/0067131 | A1 | 4/2004 | Joslin | |
| 2006/0245715 | A1 | 11/2006 | Matsumoto et al. | |
| 2007/0212215 | A1 | 9/2007 | Ferber et al. | |
| 2009/0191053 | A1 | 7/2009 | Bridge et al. | |
| 2010/0047056 | A1 * | 2/2010 | Lee | F01D 9/041 415/115 |
| 2012/0230826 | A1 * | 9/2012 | Raible | F01D 5/143 416/196 R |
| 2013/0052020 | A1 | 2/2013 | Noible | |
| 2013/0309075 | A1 | 11/2013 | Brummitt-Brown | |
| 2017/0138368 | A1 * | 5/2017 | Maalouf | F02C 3/04 |
| 2017/0306768 | A1 | 10/2017 | Szrajer et al. | |
| 2017/0356298 | A1 | 12/2017 | Carty | |

FOREIGN PATENT DOCUMENTS

| | | | | |
|---|---|---|---|---|
| EP | 1873355 | A1 * | 1/2008 | F01D 5/225 |
| EP | 3054104 | | 8/2016 | |
| EP | 3170988 | | 5/2017 | |
| GB | 1157868 | | 7/1969 | |
| GB | 2139295 | | 11/1984 | |
| GB | 2139295 | A * | 11/1984 | F28F 13/00 |
| JP | S54132011 | | 10/1979 | |
| JP | 09133003 | A * | 5/1997 | F01D 5/225 |
| JP | H09133003 | | 5/1997 | |
| JP | 2001200701 | | 7/2001 | |

* cited by examiner

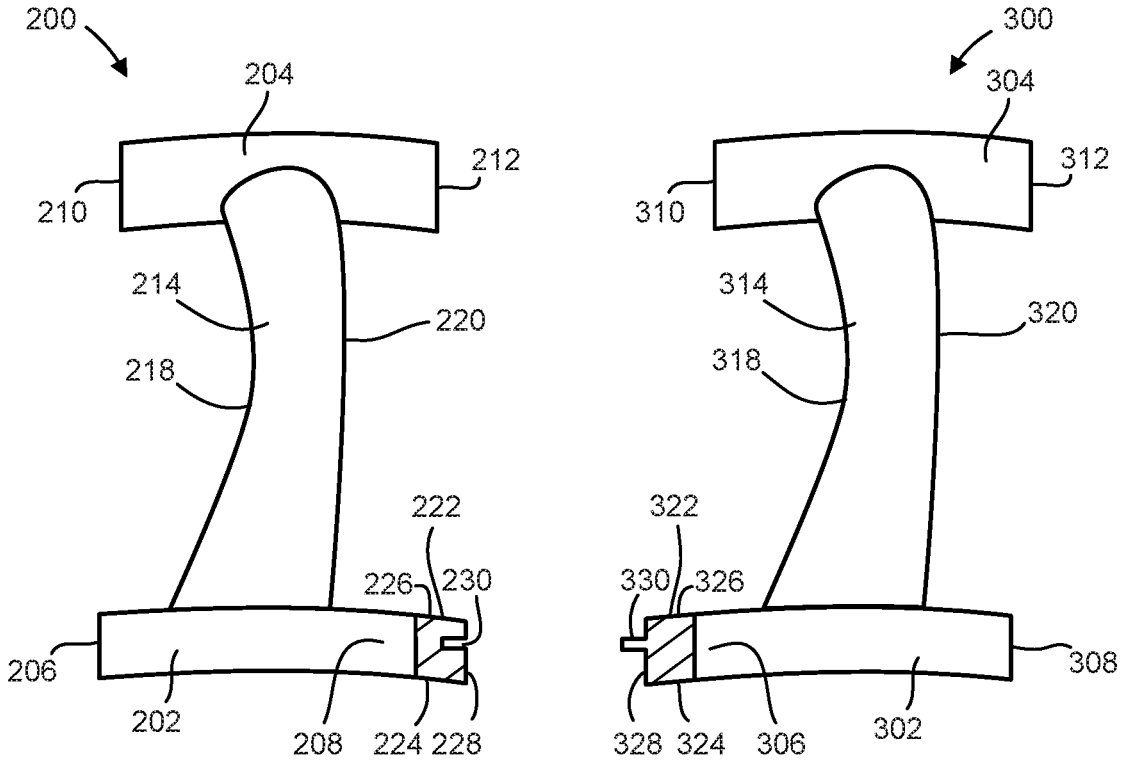
FIG.3A
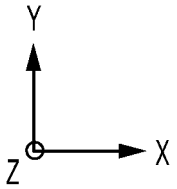

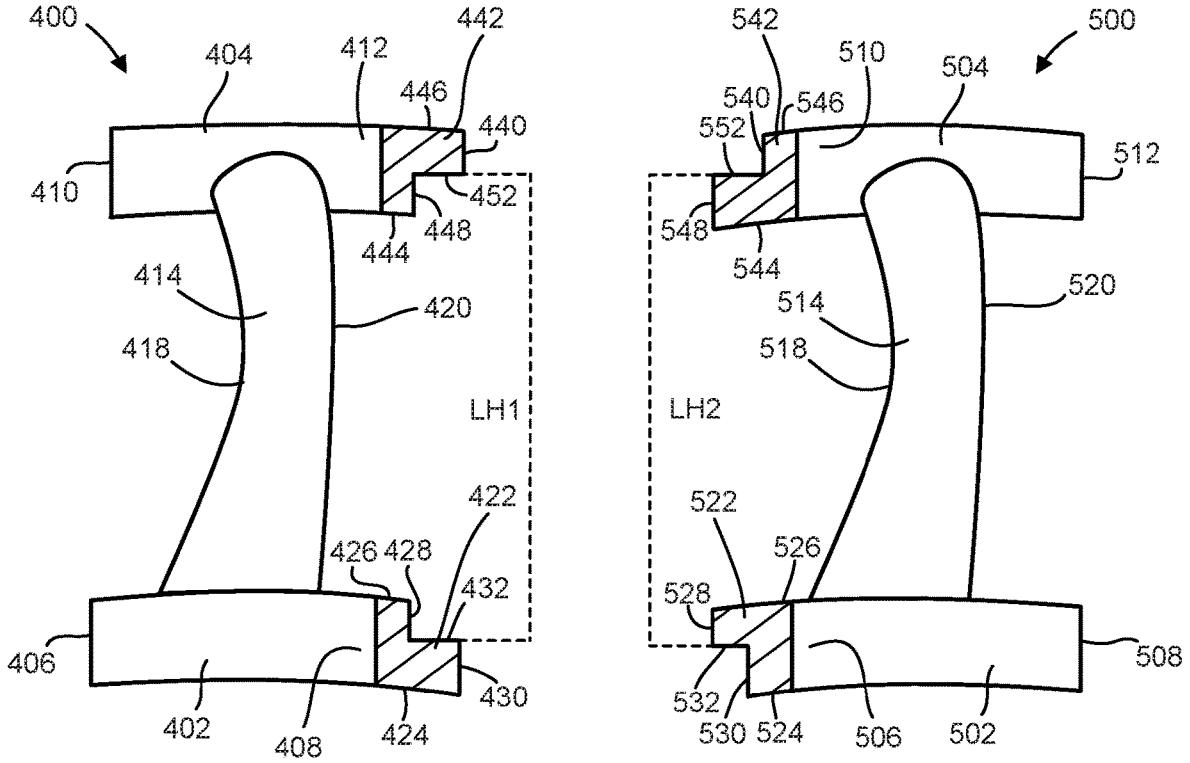
FIG.3B
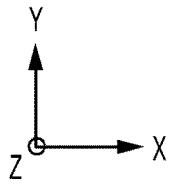

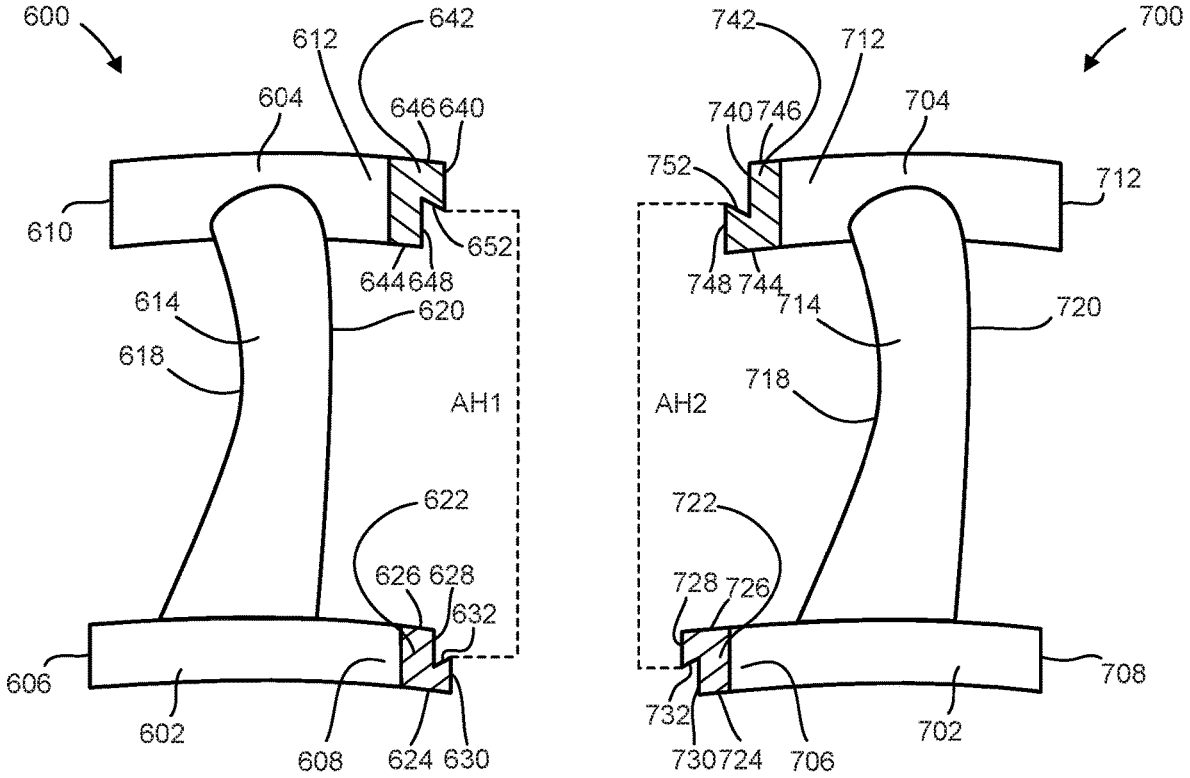
FIG.3C
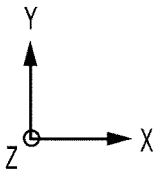

CONTACT COUPLED SINGLETS

FIELD OF THE DISCLOSURE

The present disclosure relates to airfoil vanes and blades, and more particularly, to airfoil vanes and blades on gas turbine engines.

BACKGROUND OF THE DISCLOSURE

Gas turbine engines typically include a fan section, a compressor section, a combustor section and a turbine section. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads. One or more sections of the gas turbine engine may include a plurality of vane assemblies having vanes interspersed between rotor assemblies that carry the blades of successive stages of the section. Each vane assembly and/or blade assembly may comprise a plurality of a vanes and/or blades, respectively installed within an engine case to form an annular structure. The vanes and/or blades are typically are cast in pairs and coupled together to form the annular structure.

SUMMARY OF THE DISCLOSURE

An airfoil assembly may comprise a first segment comprising a first shroud and a second shroud radially outward of the first shroud, a second segment comprising a first shroud and a second shroud radially outward of the first shroud, and a first coupling coupled to at least one of the first shroud or the second shroud of the first segment and a second coupling coupled to at least one of the first shroud or the second shroud of the second segment, wherein the first segment and the second segment are coupled together by a first land of the first coupling and a second land of the second coupling.

In various embodiments, the first coupling may further comprise a first mating wall and a second mating wall radially outward of the first mating wall. The second coupling may further comprise a first mating wall and a second mating wall radially outward of the first mating wall. The first mating wall of the first coupling may be configured to mate with the first mating wall of the second coupling and the second mating wall of the first coupling may be configured to mate with the second mating wall of the second coupling. The first coupling may be on a suction side edge of the first shroud of the first segment and the second coupling may be on a pressure side edge of the first shroud of the second segment. The airfoil assembly may further comprise a third coupling on the suction side edge of the second shroud of the first segment and further comprise a fourth coupling on the pressure side edge of the second shroud of the second segment. The first coupling may be on a pressure side edge of the first shroud of the first segment and the second coupling may be on a suction side edge of the first shroud of the second segment. The airfoil assembly may further comprise a third coupling on the pressure side edge of the second shroud of the first segment and further comprise a fourth coupling on the suction side edge of the second shroud of the second segment. The first coupling may be cast as a monolithic portion of the first segment and the second coupling may be cast as a monolithic portion of the second segment. The airfoil assembly may comprise a vane assembly comprising a first vane body extending radially outward from the first shroud to the second shroud of the first segment and a second vane body extending radially outward from the first shroud to the second shroud of the second segment. The airfoil assembly may comprise a blade assembly comprising a first blade body extending radially outward from the first shroud to the second shroud of the first segment and a second blade body extending radially outward from the first shroud to the second shroud of the second segment.

A gas turbine engine may comprise an airfoil assembly comprising a first segment comprising a first coupling and a second segment comprising a second coupling wherein the first segment and second segment are coupled together by a first angled surface of the first coupling and a second angled surface of the second coupling.

In various embodiments, the first segment may further comprise a first shroud and a second shroud radially outward of the first shroud, the first coupling coupled to at least one of the first shroud or second shroud. The second segment may further comprise a first shroud and a second shroud radially outward of the first shroud, the second coupling coupled to at least one of the first shroud or second shroud. The first coupling may further comprise a first mating wall and a second mating wall radially outward of the first mating wall. The second coupling may further comprise a first mating wall and a second mating wall radially outward of the first mating wall.

A method of manufacturing an airfoil assembly may comprise casting a first segment comprising a first shroud, a second shroud, and a first coupling attached to at least one of the first shroud or second shroud, casting a second segment comprising a first shroud, a second shroud, and a second coupling attached to at least one of the first shroud or the second shroud, heating the first segment to allow thermal expansion of the first segment, cooling the second segment to allow thermal shrinking of the second segment, coupling the first segment and the second segment together by mating the first coupling of the first segment to the second coupling of the second segment, and allowing the first segment and the second segment to return to an ambient temperature.

In various embodiments, the method may further comprise casting a third segment comprising a first shroud, a second shroud, and a third coupling attached to at least one of the first shroud or second shroud. The method may further comprise cooling the third segment and coupling the first segment and the third segment together. The method may further comprise heating the third segment and coupling the second segment and the third segment together.

The foregoing features and elements may be combined in various combinations without exclusivity, unless expressly indicated otherwise. These features and elements as well as the operation thereof will become more apparent in light of the following description and the accompanying drawings. It should be understood, however, the following description and drawings are intended to be exemplary in nature and non-limiting.

BRIEF DESCRIPTION OF THE DRAWINGS

The accompanying drawings are included to provide a further understanding of the present disclosure and are incorporated in, and constitute a part of, this specification, illustrate various embodiments, and together with the description, serve to explain the principles of the disclosure.

FIG. 3A illustrates an axial view of a pair of airfoil singlets being coupled together, in accordance with various embodiments;

FIG. 3B illustrates an axial view of a pair of airfoil singlets being coupled together, in accordance with various embodiments;

FIG. 3C illustrates an axial view of a pair of airfoil singlets being coupled together, in accordance with various embodiments;

DETAILED DESCRIPTION

The detailed description of various embodiments herein makes reference to the accompanying drawings, which show various embodiments by way of illustration. While these various embodiments are described in sufficient detail to enable those skilled in the art to practice the disclosure, it should be understood that other embodiments may be realized and that logical, chemical, electrical, and mechanical changes may be made without departing from the spirit and scope of the disclosure. Thus, the detailed description herein is presented for purposes of illustration only and not of limitation.

For example, the steps recited in any of the method or process descriptions may be executed in any order and are not necessarily limited to the order presented. Furthermore, any reference to singular includes plural embodiments, and any reference to more than one component or step may include a singular embodiment or step. Also, any reference to attached, fixed, connected, or the like may include permanent, removable, temporary, partial, full, and/or any other possible attachment option. Additionally, any reference to without contact (or similar phrases) may also include reduced contact or minimal contact.

For example, in the context of the present disclosure, methods, systems, and articles may find particular use in connection with vane or blade assemblies of gas turbine engines. However, various aspects of the disclosed embodiments may be adapted for performance in a variety of other systems. As such, numerous applications of the present disclosure may be realized.

Various embodiments of the present disclosure allow vanes or blades to be cast as singlets and coupled together to form an airfoil assembly using thermal fitting techniques. Typical vane and/or blade assemblies are formed by casting vanes or blades as clusters comprising more than one vane or blade. The process of casting vanes or blades as clusters may result in a relatively low yield due to the complexity of the geometry associated with the clusters. Additionally, coating clusters of vanes or blades with protective coatings such as thermal barrier coatings (TBCs) or drilling film holes in the vanes or blades may be more difficult in vane or blade clusters due to shadowing of one blade or vane over the other, preventing a clean line of sight for said coating and/or drilling. Accordingly, various embodiments of the present disclosure allow vanes or blades to be cast as singlets and securely coupled together to form a vane or blade assembly, while also increasing the ease in which the vanes or blades may be coated and/or drilled for film holes.

Figure 1:
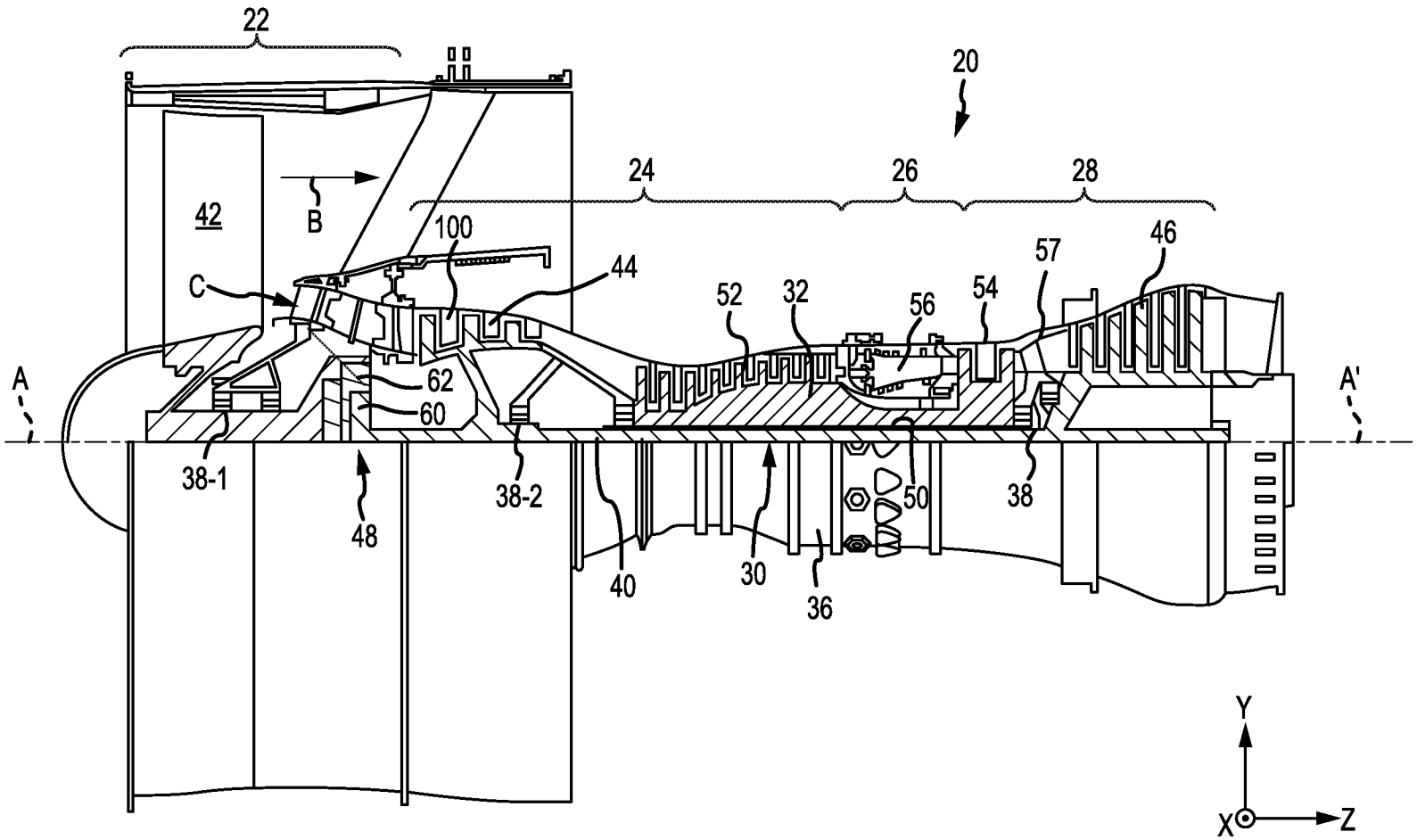
FIG. 1 illustrates a schematic view of a gas turbine engine, in accordance with various embodiments.

In various embodiments and with reference to FIG. 1, a gas-turbine engine 20 is provided. Gas-turbine engine 20 may be a two-spool turbofan that generally incorporates a fan section 22, a compressor section 24, a combustor section 26 and a turbine section 28. In operation, fan section 22 can drive coolant along a bypass flow path B while compressor section 24 can drive coolant along a core flow path C for compression and communication into combustor section 26 then expansion through turbine section 28. Although depicted as a turbofan gas-turbine engine 20 herein, it should be understood that the concepts described herein are not limited to use with turbofans as the teachings may be applied to other types of turbine engines including three-spool architectures.

Gas-turbine engine 20 may generally comprise a low speed spool 30 and a high speed spool 32 mounted for rotation about an engine central longitudinal axis A-A' relative to an engine static structure or engine case structure 36 via several bearing systems 38, 38-1, and 38-2. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor section 44 and a low pressure turbine section 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54. A combustor 56 may be located between high pressure compressor 52 and high pressure turbine 54. A mid-turbine frame 57 of engine case structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

Gas-turbine engine 20 may be, for example, a high-bypass ratio geared aircraft engine. In various embodiments, the bypass ratio of gas-turbine engine 20 may be greater than about six (6). In various embodiments, the bypass ratio of gas-turbine engine 20 may be greater than ten (10). In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas-turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other turbine engines including direct drive turbofans. A gas turbine engine may comprise an industrial gas turbine (IGT) or a geared aircraft engine, such as a geared turbofan, or non-geared aircraft engine, such as a turbofan, a turboshaft, or may comprise any gas turbine engine as desired.

In various embodiments, an engine section, such as fan section 22, compressor section 24 and/or turbine section 28, may comprise one or more stages or sets of rotating blades and one or more stages or sets of stationary vanes axially interspersed with the associated blade stages but non-rotating about engine central longitudinal axis A-A'. For example, the rotor assemblies may carry a plurality of rotating blades, while each vane assembly 100 may carry a plurality of vanes that extend into the core flow path C. The blades may rotate about engine central longitudinal axis A-A', while the vanes may remain stationary about engine central longitudinal axis A-A'. The blades may create or extract energy (in the form of pressure) from the core airflow that is communicated through the engine section along the core flow path C. The vanes may direct the core airflow to the blades to either add or extract energy. A plurality of vane assemblies 100 may be disposed throughout the core flow path C to impart desirable flow characteristics on the gas flowing through the core flow path C. Vane assemblies 100 may at least one row of vanes arranged circumferentially about the engine central longitudinal axis A-A'.

Figure 2:
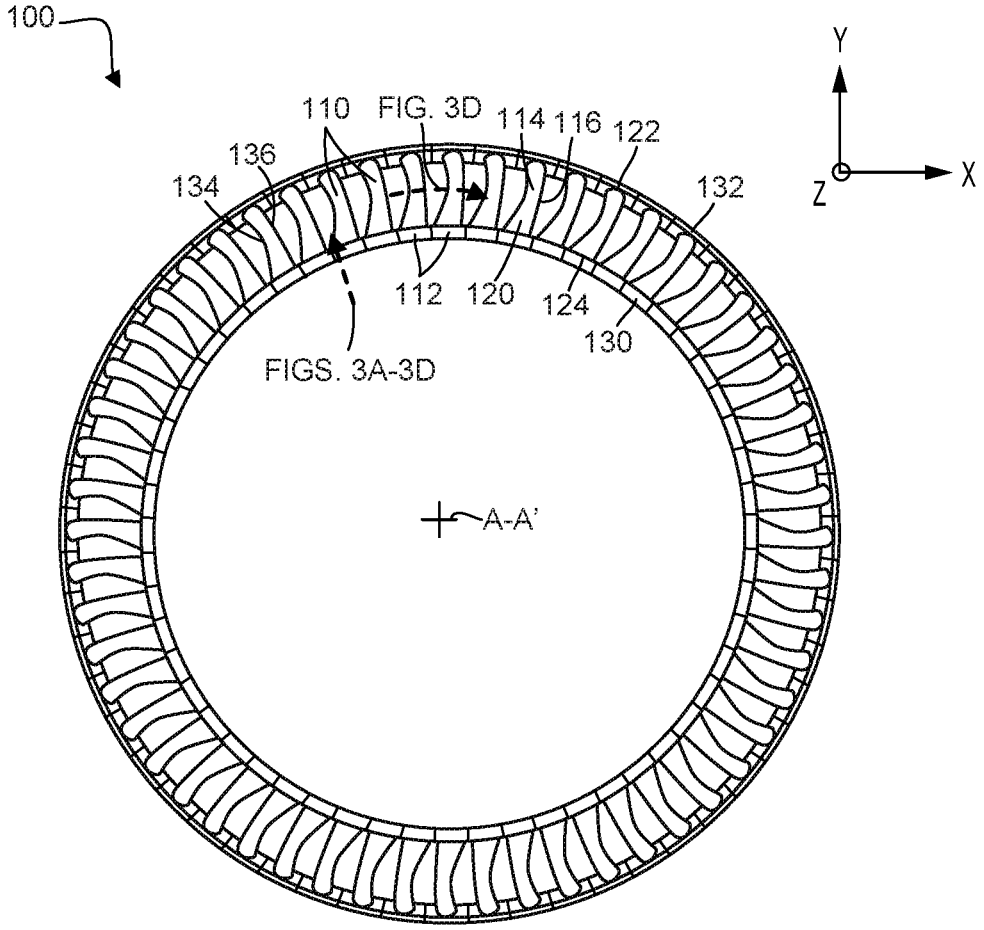
FIG. 2 illustrates an axial view of an airfoil assembly of a gas turbine engine, in accordance with various embodiments.

Referring to FIGS. 1 and 2, a vane assembly 100 may include a plurality of vanes 110, which may be arranged into subassemblies or vane segments 112. While referred to herein with reference to vanes 110 and/or vane assemblies 100, concepts herein may be equally applied to blades and/or blade assemblies or other airfoil components. A vane assembly 100 may include a partial or a complete circumferential array of vanes 110. In various embodiments, vane assembly 100 may comprise a continuous annular vane assembly or a plurality of vane segments 112. In various embodiments, each vane 110 may be a separate component from each adjacent vane 110. Vanes 110 may be grouped into vane segments 112 and arranged circumferential about engine central longitudinal axis A-A' to provide the vane assembly 100. Vanes 110 and/or vane segments 112 may be mounted in circumferentially abutting relationship to form an annular ring.

With continued reference to FIG. 2, a portion of a vane assembly 100 of FIG. 1 is illustrated, in accordance with various embodiments. Each of the vanes 110 may comprise a leading edge 114, a trailing edge 116, a pressure side 134, and a suction side 136. Leading edge 114 and trailing edge 116 may be configured to direct airflow through gas-turbine engine 20. Leading edge 114 may positioned proximate to a forward portion of the gas turbine engine, while trailing edge 116 may positioned aft of leading edge 114. As referred to herein, forward may refer to a direction in the positive Z-direction, while aft may refer to a direction in the negative Z-direction. A vane 110 may comprise, for example, an airfoil body 120. Vane 110 may comprise a radially outer end 122 and a radially inner end 124 with airfoil body 120 extending between radially outer end 122 and radially inner end 124. Radially outer end 122 may be a distal end of vane 110. Radially inner end 124 may be a proximal end of vane 110. A distance between radially outer end 122 and radially inner end 124 may, for example, comprise a span of airfoil body 120.

In various embodiments, each vane 110 of vane assembly 100 may be circumferentially retained to the engine at an outer diameter and/or an inner diameter of the vane assembly 100. Vanes 110 may be cantilevered with an attachment point at radially inner end 124 or at radially outer end 122. A radially inner end 124 of vane 110 may couple to an inner shroud 130. Vane assembly 100 may include an inner shroud 130, which may be an inner circumferential fixed structure comprised of one or more segments. In various embodiments, a plurality of vanes 110 may be coupled to a segment of inner shroud 130 to form a vane segment 112. Radially outer end 122 of vane 110 may couple to an outer shroud 132. In various embodiments, vane 110 may be monolithic with a portion of inner shroud 130 and/or outer shroud 132. For example, each vane 110 may include a discrete portion of outer shroud 132 monolithic with the vane 110. Thus, each vane segment 112 may include a single vane 110 or a plurality of vanes 110 forming a portion of outer shroud 132, and vanes 110 of the vane segment 112 may be coupled to a segment of inner shroud 130. In various embodiments, each vane 110 may be coupled together at inner shroud 130 and outer shroud 132 to form vane assembly 100. For example, each vane segment 112 may be cast as a singlet (or individual vane 110) and coupled to another vane segment 112 on both a pressure side and a suction side. In turn, multiple vane segments 112 may be coupled together to form a complete vane assembly 100. In various embodiments, vane segments 112 may comprise doublets (a pair of vanes 110 cast together), triplets (three vanes 110 cast together), or any other number of vanes 110 cast together to form vane segment 112. In various embodiments, vane assembly 100 may be formed by casting each vane segment 112 as a singlet and coupling multiple singlets to form a progressively larger portion of vane assembly 100 until vane assembly 100 is formed as a complete annular structure.

Referring now to FIG. 3A, a first singlet 200 is shown adjacent to a second singlet 300. First singlet 200 may comprise a shrouded singlet comprising inner shroud 202 and an outer shroud 204 radially outward of inner shroud 202 or may comprise an unshrouded singlet in accordance with various embodiments. Inner shroud 202 may comprise a pressure side edge 206 and a suction side edge 208. Similarly, outer shroud 204 may comprise a pressure side edge 210 and a suction side edge 212. Inner shroud 202 may be radially outward (in the positive Y-direction) and coupled to airfoil body 214, while outer shroud 204 may be radially inward (in the negative Y-direction) and coupled to airfoil body 214. Airfoil body 214 may comprise a pressure side 218 and a suction side 220 opposite pressure side 218.

Similarly, second singlet 300 may comprise an inner shroud 302 and an outer shroud 304 radially outward of inner shroud 302. Inner shroud 302 may comprise a pressure side edge 306 and a suction side edge 308. Similarly, outer shroud 304 may comprise a pressure side edge 310 and a suction side edge 312. Inner shroud 302 may be radially outward (in the positive Y-direction) and coupled to airfoil body 314, while outer shroud 304 may be radially inward (in the negative Y-direction) and coupled to airfoil body 314. Airfoil body 314 may comprise a pressure side 318 and a suction side 320 opposite pressure side 318.

Still referring to FIG. 3A, first singlet 200 may comprise a first coupling 222, while second singlet 300 may comprise a second coupling 322. First coupling 222 may be positioned at suction side edge 208 of inner shroud 202, while second coupling 322 may be positioned at pressure side edge 306 of inner shroud 302. First coupling 222 and second coupling 322 may be cast with first singlet 200 and second singlet 300, respectively, such that first coupling 222 is monolithic with first singlet 200 and second coupling 322 is monolithic with second singlet 300. While depicted only on suction side edge 208 of inner shroud 202 and pressure side edge 306 of inner shroud 302, respectively, first singlet 200 and second singlet 300 are not limited in this regard and may comprise additional couplings on either or both of the pressure side edges and suction sides edges of the inner and outer shrouds.

First coupling 222 may comprise an inner wall 224 and an outer wall 226 radially outward of inner wall 224. A mating wall 228 may extend radially between inner wall 224 and outer wall 226 and be configured to mate with a mating wall of another singlet. In various embodiments, first coupling 222 may comprise a female connector 230 extending inwardly (in the negative X-direction) from mating wall 228 and radially between inner wall 224 and outer wall 226. While illustrated as comprising a rectangular cross-sectional shape in FIG. 3A, female connector 230 is not limited in this regard and may comprise any other suitable cross-sectional shape.

Second coupling 322 may comprise an inner wall 324 and an outer wall 326 radially outward of inner wall 324. A mating wall 328 may extend radially between inner wall 324 and outer wall 326 and be configured to mate with a mating wall of another singlet. In various embodiments, second coupling 322 may comprise a male connector 330 extending outwardly (in the negative X-direction) from mating wall 328 and radially between inner wall 324 and outer wall 326. While illustrated as comprising a rectangular cross-sectional shape in FIG. 3A, male connector 330 is not limited in this regard and may comprise any other suitable cross-sectional shape.

In various embodiments, a cross-sectional area of female connector 230 may be approximately equal to or less than a cross-sectional area of male connector 330 at an ambient temperature. First singlet 200 may be heated for a period of time such that first singlet 200 undergoes thermal expansion, including throughout first coupling 222. Second singlet 300 may be cooled for a period of time such that second single undergoes thermal shrinking, including throughout second coupling 322. As first coupling 222 expands and second coupling 322 shrinks, the cross-sectional area of female connector 230 may increase and the cross-sectional area of male connector 330 may decrease. As such, male connector 330 may be inserted into female connector 230 such that mating wall 328 of second singlet 300 may mate with mating wall 228 of first singlet 200. First singlet 200 and second singlet 300 return to an ambient temperature, thereby shrinking and expanding, respectively, coupling first singlet 200 and second singlet 300 together by an interference connection. In various embodiments, first singlet 200 and second singlet 300 may be coupled by mating the components in a circumferential direction (along the X-axis), however they are not limited in this regard.

Moving on and with reference to FIG. 3B, a first singlet 400 and a second singlet 500 are illustrated with alternative couplings, in accordance with various embodiments. First singlet 400 may comprise a first coupling 422 positioned on suction side edge 408 of inner shroud 402 and a second coupling 442 positioned on suction side edge 412 of outer shroud 404. Second singlet 500 may comprise a first coupling 522 positioned on a pressure side edge 506 of inner shroud 502 and a second coupling 542 positioned on pressure side edge 510 of outer shroud 504. In various embodiments, first singlet 400 and/or second singlet 500 may comprise additional couplings positioned on pressure sides of inner and outer shroud of first singlet 400 and suction sides of inner and outer shroud of second singlet 500, respectively.

First coupling 422 of first singlet 400 may comprise an inner wall 424 and an outer wall 426 radially outward of inner wall 424. First coupling 422 may further comprise a first mating wall 430 and a second mating wall 428 radially outward of first mating wall 430. First mating wall 430 and second mating wall 428 may extend an entire distance from inner wall 424 to outer wall 426 and be equal to a height (measured in the Y-direction) of inner shroud 402. First coupling 422 may further comprise a land 432 positioned between first mating wall 430 and second mating wall 428 and substantially perpendicular to first mating wall 430 and second mating wall 428.

Similarly, second coupling 422 of first singlet 400 may comprise an inner wall 444 and an outer wall 446 radially outward of inner wall 444. Second coupling 442 may further comprise a first mating wall 440 and a second mating wall 448 radially inward of first mating wall 440. First mating wall 430 and second mating wall 428 may extend an entire distance from inner wall 424 to outer wall 426 and be equal to a height of outer shroud 404. Second coupling 442 may further comprise a land 452 positioned between first mating wall 440 and second mating wall 448 and substantially perpendicular to first mating wall 440 and second mating wall 448.

First coupling 522 of second singlet 500 may comprise an inner wall 524 and an outer wall 526 radially outward of inner wall 524. First coupling 522 may further comprise a first mating wall 530 and a second mating wall 528 radially outward of first mating wall 530. First mating wall 530 and second mating wall 528 may extend an entire distance from inner wall 524 to outer wall 526 and be equal to a height of inner shroud 502. First coupling 522 may further comprise a land 532 positioned between first mating wall 530 and second mating wall 528 and substantially perpendicular to first mating wall 530 and second mating wall 528.

Similarly, second coupling 542 of second singlet 500 may comprise an inner wall 544 and an outer wall 546 radially outward of inner wall 544. Second coupling 542 may further comprise a first mating wall 540 and a second mating wall 548 radially inward of first mating wall 540. First mating wall 540 and second mating wall 548 may extend an entire distance from inner wall 524 to outer wall 526 and be equal to a height of outer shroud 504. Second coupling 542 may further comprise a land 552 positioned between first mating wall 540 and second mating wall 548 and substantially perpendicular to first mating wall 540 and second mating wall 548.

In various embodiments, first singlet 400 may comprise a first land height, LH1, measured from first coupling 422 land 432 to second coupling 442 land 452. Second singlet 500 may comprise a second land height LH2, measured in the Y-direction from first coupling 522 land 532 to second coupling 542 land 552. First land height LH1 may be equal to or less than second land height LH2 in various embodiments. First singlet 400 may be heated for a period of time such that first singlet 400 undergoes thermal expansion, including throughout first land height LH1. Second singlet 500 may be cooled for a period of time such that second singlet 500 undergoes thermal shrinking, including throughout second land height LH2. First land height LH1 may expand and second land height LH2 may shrink, allowing first singlet 400 to be coupled with second singlet 500 by first coupling 422, second coupling 442, first coupling 522, and second coupling 542. Specifically, first singlet 400 may be aligned with second singlet 500 such that land 532 of first coupling 522 sits radially outward of land 432 of first coupling 422. Likewise, land 552 of second coupling 542 may be aligned with land 452 of second coupling 442 such that land 552 of second coupling 542 sits radially inward of land 452 of second coupling 442. First singlet 400 and second singlet 500 may be allowed to return to an ambient temperature, thereby shrinking and expanding, respectively, coupling first singlet 400 and second singlet 500 together by an interference connection. In various embodiments, first singlet 400 and second singlet 500 may be coupled by mating the components in a circumferential direction (along the X-axis), however they are not limited in this regard.

With reference to FIG. 3C, first singlet 600 and second singlet 700 are illustrated with alternative couplings, in accordance with various embodiments. First singlet 600 may comprise a first coupling 622 positioned on suction side edge 608 of inner shroud 602 and a second coupling 642 positioned on suction side edge 612 of outer shroud 604. Second singlet 700 may comprise a first coupling 722 positioned on a pressure side edge 706 of inner shroud 702 and a second coupling 743 positioned on suction side edge 710 of outer shroud 704. In various embodiments, additional couplings may be positioned on pressure sides of inner and outer shroud of first singlet 600 and suction sides of inner and outer shroud of second singlet 700, respectively.

First coupling 622 of first singlet 600 may comprise an inner wall 624 and an outer wall 626 radially outward of inner wall 624. First coupling 622 may further comprise a first mating wall 630 and a second mating wall 628 radially outward of first mating wall 630. First coupling 622 may further comprise an angled surface 632 connecting first mating wall 630 and second mating wall 628 at an angle relative to first mating wall 630 and second mating wall 628. Angled surface 632 may extend radially outward and in the positive X-direction from first mating wall 630 to second mating wall 628, however is not limited in this regard and may be positioned at other angles in relation to first mating wall 630 and second mating wall 628.

Similarly, second coupling 622 of first singlet 600 may comprise an inner wall 644 and an outer wall 646 radially outward of inner wall 644. Second coupling 642 may further comprise a first mating wall 640 and a second mating wall 648 radially inward of first mating wall 640. Second coupling 642 may further comprise an angled surface 652 connecting first mating wall 640 and second mating wall 648 at an angle relative first mating wall 640 and second mating wall 648. Angled surface 652 may extend radially inward in the positive X-direction from second mating wall 648 to first mating wall 640, however is not limited in this regard and may be positioned at other angles in relation to first mating wall 640 and second mating wall 648.

First coupling 722 of second singlet 700 may comprise an inner wall 724 and an outer wall 726 radially outward of inner wall 724. First coupling 722 may further comprise a first mating wall 730 and a second mating wall 728 radially outward of first mating wall 730. First coupling 722 may further comprise an angled surface 732 connecting first mating wall 730 and second mating wall 728 at an angle relative first mating wall 730 and second mating wall 728. Angled surface 732 may extend radially outward and in the positive X-direction from second mating wall 728 to first mating wall 730, however is not limited in this regard and may be positioned at other angles in relation to first mating wall 730 and second mating wall 728.

Similarly, second coupling 742 of second singlet 700 may comprise an inner wall 744 and an outer wall 746 radially outward of inner wall 744. Second coupling 742 may further comprise a first mating wall 740 and a second mating wall 748 radially inward of first mating wall 740. Second coupling 742 may further comprise an angled surface 752 connecting first mating wall 740 and second mating wall 748 at an angle relative first mating wall 740 and second mating wall 748. Angled surface 752 may extend radially inward and in the positive X-direction from first mating wall 740 to second mating wall 748, however is not limited in this regard and may be positioned at other angles in relation to first mating wall 740 and second mating wall 748.

In various embodiments, first singlet 600 may comprise a first angle height, AH1, measured from a first mating point of angled surface 632 and first mating wall 630 of first coupling 622 to a second mating point of angled surface 652 and first mating wall 640 of second coupling 642. Second singlet 700 may comprise a second angle height, AH2, measured from a first mating point of angled surface 732 and second mating wall 728 of first coupling 722 to a second mating point of angled surface 752 and second mating wall 748 of second coupling 742. First angle height AH1 may be equal to or less than second angle height AH2 in various embodiments. First singlet 600 may be heated for a period of time such that first singlet 600 undergoes thermal expansion, including throughout first angle height AH1. Second singlet 700 may be cooled for a period of time such that second singlet 700 undergoes thermal shrinking, including throughout second angle height AH2. First angle height AH1 may expand and second angle height AH2 may shrink, allowing first singlet 600 to be coupled with second singlet 700 by first coupling 622, second coupling 642, first coupling 722, and second coupling 742. Specifically, first singlet 600 may be aligned with second singlet 700 such that angled surface 732 of first coupling 722 sits radially outward of angled surface 632 of first coupling 622. Likewise, angled surface 752 of second coupling 742 may be aligned with angled surface 652 of second coupling 642 such that angled surface 752 of second coupling 742 sits radially inward of angled surface 652 of second coupling 642. First singlet 600 and second singlet 700 return to an ambient temperature, thereby shrinking and expanding, respectively, coupling first singlet 600 and second singlet 700 together by an interference connection. Angled surfaces 632, 642, 732, and 742 may increase the amount of surface contact between first singlet 600 and second singlet 700. In various embodiments, singlet 600 and singlet 700 may be coupled by mating the components in an axial direction (along the Z-axis), however they are not limited in this regard.

Figure 3D:
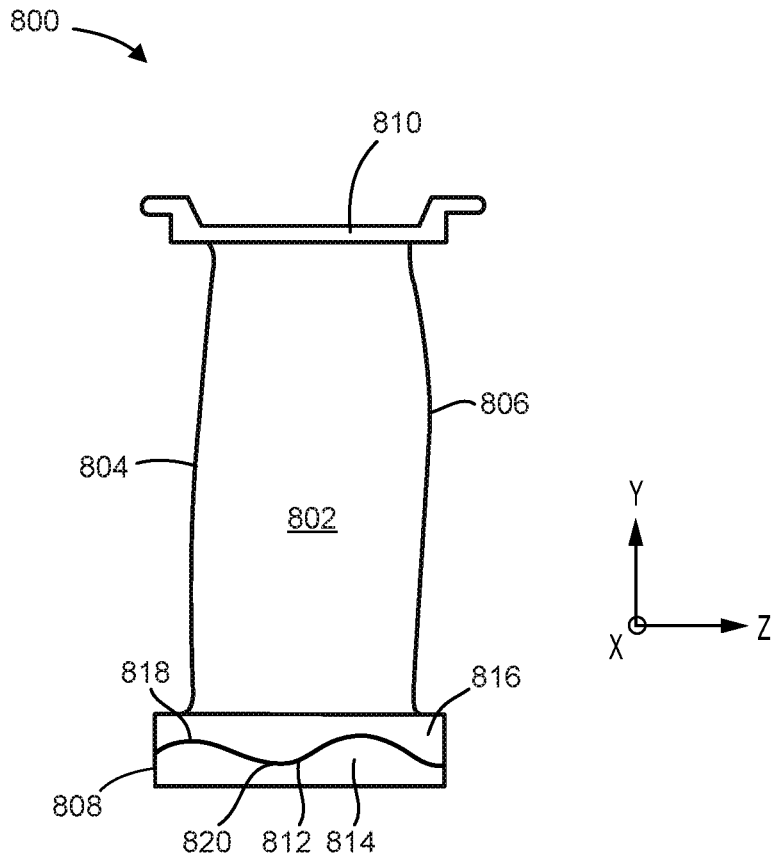
FIG. 3D illustrates a circumferential view of an airfoil singlet, in accordance with various embodiments.

Moving on and with reference to FIG. 3D, a singlet 800 is depicted from a circumferential view, in accordance with various embodiments. Singlet 800 may comprise an airfoil body 802 comprising a leading edge 804 and a trailing edge 806 opposite leading edge 804. Airfoil body 802 may be coupled to an inner shroud 808 and a radially inner surface and an outer shroud 810 at a radially outer surface. Singlet 800 may comprise a mating surface 812 extending between leading edge 804 and trailing edge 806 on inner shroud 808. While illustrated as only comprising one mating surface 812 on inner shroud 808, singlet 800 is not limited in this regard and may comprise additional mating surfaces on outer shroud 810 or portions of a reverse side of singlet 800.

Mating surface 812 may separate inner shroud 808 into a first portion 814 and a second portion 816 radially outward of first portion 814. First portion 814 and second portion 816 may not be flush with each other in various embodiments. Stated otherwise, first portion 814 may extend farther or less than second portion 816 in the positive Z-direction. As such, first portion 814 and second portion 816 may be staggered relative to each other when viewed from the Y-X plane. Mating surface 812, first portion 814, and second portion 816 may be configured to mate with a mating surface, first portion, and second surface of another singlet. Specifically, singlet 800 may be heated or cooled to allow thermal expansion or thermal shrinking of singlet 800. Singlet 800 may then be thermally coupled with another singlet in a similar fashion as described with reference to FIGS. 3A-3C. In various embodiments, peaks 818 of mating surface 812 may align with valleys of a counterpart singlet and valleys 820 of mating surface 812 align with the peaks of a counterpart singlet. As such, singlet 800 comprising mating surface 812 may constrain movement of singlet 800 relative to another singlet in an axial direction (the Z-direction). While illustrated as a sinusoidal wave in FIG. 3D, mating surface 812 is not limited in this regard and may comprise any other suitable shape, including but not limited to a mating surface comprising a square, triangle, or sawtooth wave. In various embodiments, singlet 800 may be coupled to another singlet by mating the components in a circumferential direction (along the X-axis), however they are not limited in this regard.

Figure 4:
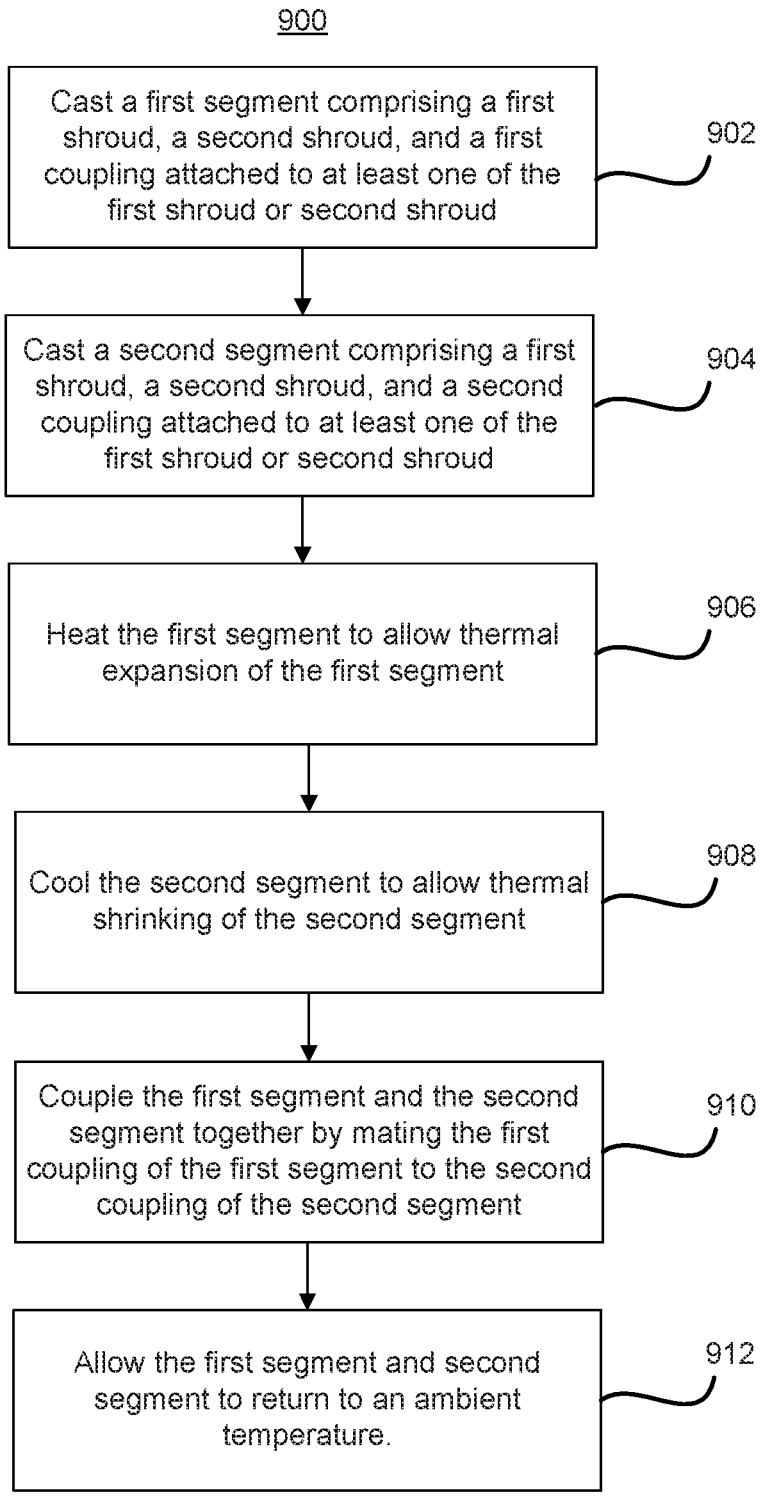
FIG. 4 illustrates a block diagram illustrating a method of coupling a pair of airfoil segments, in accordance with various embodiments.

A block diagram illustrating a method 900 of manufacturing an airfoil assembly is illustrated in FIG. 4, in accordance with various embodiments. The method may comprise casting a first segment comprising a first shroud, a second shroud, and a first coupling attached to at least one of the first shroud or second shroud (step 902). The method may further comprise casting a second segment comprising a first shroud, a second shroud, and a first coupling attached to at least one of the first shroud or second shroud (step 904). The method may further comprise heating the first segment to allow thermal expansion of the first segment (step 906). The method may further comprise cooling the second segment to allow thermal shrinking of the second segment (step 908). The method may further comprise coupling the first segment and the second segment together by mating the first coupling of the first segment to the second coupling of the second segment (step 910). The method may further comprise allowing the first segment and the second segment to return to an ambient temperature (step 912).

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure. The scope of the disclosure is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

Methods, systems, and computer-readable media are provided herein. In the detailed description herein, references to "one embodiment", "an embodiment", "various embodiments", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f) unless the element is expressly recited using the phrase "means for." As used herein, the terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. An airfoil assembly, comprising:

a first segment comprising a first shroud and a second shroud radially outward of the first shroud, the first segment comprising a first circumferential side and a second circumferential side;

a second segment comprising a third shroud and a fourth shroud radially outward of the third shroud; and a first coupling coupled to at least one of the first shroud or the second shroud of the first segment on the first circumferential side of the first segment and a second coupling coupled to at least one of the third shroud or the fourth shroud of the second segment;

wherein the first segment and the second segment are coupled together by a first land of the first coupling and a second land of the second coupling, and wherein the second circumferential side is free of a coupling.

2. The airfoil assembly of claim 1, wherein the first coupling further comprises a first mating wall and a second mating wall radially outward of the first mating wall.

3. The airfoil assembly of claim 2, wherein the second coupling further comprises a third mating wall and a fourth mating wall radially outward of the third mating wall.

4. The airfoil assembly of claim 3, wherein the first mating wall of the first coupling is configured to mate with the third mating wall of the second coupling and the second mating wall of the first coupling is configured to mate with the fourth mating wall of the second coupling.

5. The airfoil assembly of claim 1, wherein the first coupling is on a suction side edge of the first shroud of the first segment and the second coupling is on a pressure side edge of the third shroud of the second segment.

6. The airfoil assembly of claim 5, further comprising a third coupling on the suction side edge of the second shroud of the first segment and further comprising a fourth coupling on the pressure side edge of the fourth shroud of the second segment.

7. The airfoil assembly of claim 1, wherein the first coupling is on a pressure side edge of the first shroud of the first segment and the second coupling is on a suction side edge of the third shroud of the second segment.

8. The airfoil assembly of claim 7, further comprising a third coupling on the pressure side edge of the second shroud of the first segment and further comprising a fourth coupling on the suction side edge of the fourth shroud of the second segment.

9. The airfoil assembly of claim 1, wherein the first coupling is cast as a first monolithic portion of the first segment and the second coupling is cast as a second monolithic portion of the second segment.

10. The airfoil assembly of claim 1, wherein the airfoil assembly comprises a vane assembly comprising a first vane body extending radially outward from the first shroud to the second shroud of the first segment and a second vane body extending radially outward from the third shroud to the fourth shroud of the second segment.

11. The airfoil assembly of claim 1, wherein the airfoil assembly comprises a blade assembly comprising a first blade body extending radially outward from the first shroud to the second shroud of the first segment and a second blade body extending radially outward from the third shroud to the fourth shroud of the second segment.

12. A gas turbine engine, comprising:

an airfoil assembly, comprising a first segment comprising a first coupling and a circumferential side disposed circumferentially opposite the first coupling; and a second segment comprising a second coupling;

wherein the first segment and the second segment are coupled together by a first angled surface of the first coupling and a second angled surface of the second coupling, and wherein the circumferential side is free of a coupling.

13. The gas turbine engine of claim 12, wherein the first segment further comprises a first shroud and a second shroud radially outward of the first shroud, the first coupling coupled to at least one of the first shroud or the second shroud.

14. The gas turbine engine of claim 12, wherein the second segment further comprises a third shroud and a fourth shroud radially outward of the third shroud, the second coupling coupled to at least one of the third shroud or the fourth shroud.

15. The gas turbine engine of claim 12, wherein the first coupling further comprises a first mating wall and a second mating wall radially outward of the first mating wall.

16. The gas turbine engine of claim 12, wherein the second coupling further comprises a third mating wall and a fourth mating wall radially outward of the third mating wall.

17. A method of manufacturing an airfoil assembly, the method comprising:

casting a first segment comprising a first shroud, a second shroud, a circumferential side, and a first coupling attached to at least one of the first shroud or the second shroud and disposed circumferentially opposite the circumferential side, wherein the circumferential side is free of a coupling;

casting a second segment comprising a third shroud, a fourth shroud, and a second coupling attached to at least one of the third shroud or the fourth shroud;

heating the first segment to allow thermal expansion of the first segment;

cooling the second segment to avow thermal shrinking of the second segment;

coupling the first segment and the second segment together by mating the first coupling of the first segment to the second coupling of the second segment; and allowing the first segment and the second segment to return to an ambient temperature.

* * * * *